US005658074A

United States Patent [19]

Guritz

[11] Patent Number: 5,658,074

[45] Date of Patent: Aug. 19, 1997

[54] PAR LAMP FIXTURE ADAPTER

[76] Inventor: Michael Lee Guritz, 8903 51st Ave. West, Bradenton, Fla. 34210

[21] Appl. No.: 513,504

[22] Filed: Aug. 10, 1995

[51] Int. Cl.[6] ..... F21V 21/00

[52] U.S. Cl. ..... 362/396; 362/226; 362/374; 439/645

[58] Field of Search ..... 362/396, 226, 362/394; 439/642, 645, 502

[56] References Cited

U.S. PATENT DOCUMENTS

| | | | |
|---|---|---|---|
| 1,335,550 | 3/1920 | Benjamin | 439/477 |
| 2,943,238 | 6/1960 | Reaves . | |
| 4,595,969 | 6/1986 | McNair | 362/226 |
| 4,772,209 | 9/1988 | Muncey | 439/36 |
| 5,199,783 | 4/1993 | Pelton | 362/226 |
| 5,428,515 | 6/1995 | Jung | 362/226 |

*Primary Examiner*—Denise L. Gromada
*Assistant Examiner*—Alfred Basichas
*Attorney, Agent, or Firm*—John C. Albrecht

[57] ABSTRACT

A fluorescent light fixture 203 replaces a PAR lamp in an existing installation without the need to rewire the installation. The replacement fixture includes a screw-in plug corresponding to the standard base of a PAR lamp and wiring between the plug and the new fixture. A tubular member receives and attaches to a PAR fixture at one end thereof; and attaches to a replacement fixture at the other end. The tubular member has stepped inside diameters to accept a variety of fixtures; and a set screw and locking nut lock the adapter to the PAR fixture.

10 Claims, 4 Drawing Sheets

PAR LAMP FIXTURE ADAPTER

TECHNICAL FIELD

Energy efficient lighting arrangements.

BACKGROUND OF THE INVENTION

Although there are extensive programs to replace many forms of incandescent lamps with more efficient e.g., fluorescent lamps, such replacement of PAR lamps requires complete replacement of the PAR fixture. This is quite expensive and generally beyond the skills of homeowners.

DISCLOSURE OF THE INVENTION

In accordance with my present invention, my lamp fixture adapter comprises: an arrangement for electrically coupling an energy efficient fixture e.g., a fluorescent lamp fixture to the socket of a PAR lamp fixture; and an arrangement for physically attaching the adapter to a PAR lamp fixture.

Advantageously, in accordance with my invention, it is possible to take advantage of energy efficient lamps in locations served by PAR lamp fixture without the need to replace or rewire an existing fixture.

DETAILED DESCRIPTION

Figure 1:
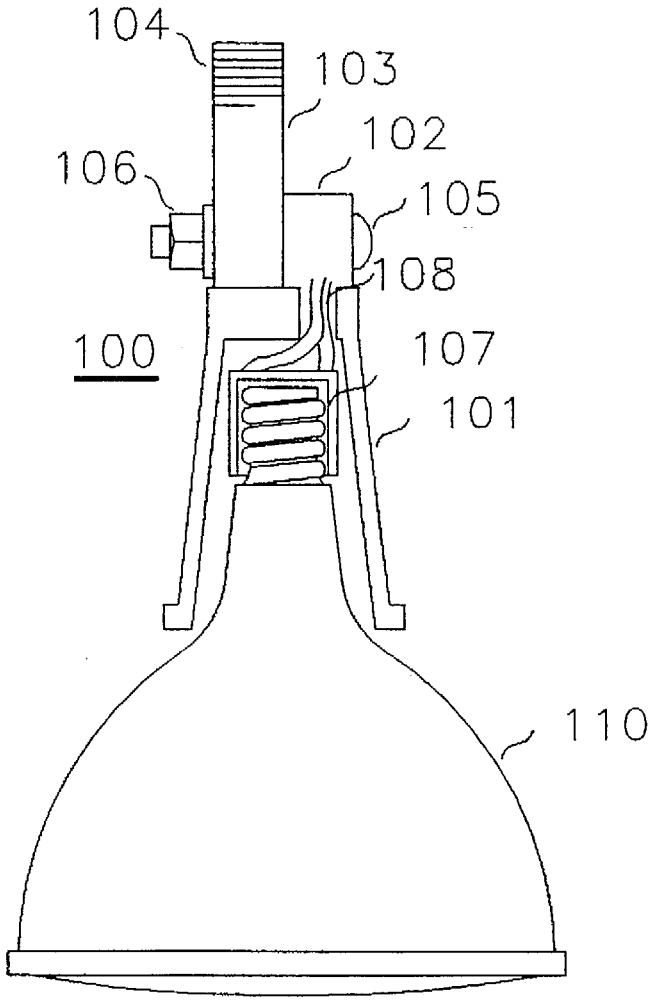
FIG. 1 (PRIOR ART)
FIG. 1 illustrates a prior art PAR lamp fixture.

In FIG. 1, the prior art PAR lamp fixture 100 is hard wired to a source of A.C.. power in a power supply box (not shown in the drawing) comprising a cover with a threaded opening for receiving the threaded portion 104 of mounting tube 103. The lamp assembly 100 of FIG. 1 comprises: a body 101; a socket 107 for receiving a standard screw-in base of PAR lamp 110; a pair of electrical conductors 108 which are connected to socket 107; mounting tube 103; bolt 105; and nut 106. Wires 108 from socket 107 are muted through a passage in a portion 102 of body 101 and thence to a source of A.C. power through mounting tube 103. A surface on portion 102 of body 101 and a mating surface on tube 103 along with bolt 105 and nut 106 form a swivel arrangement for aiming fixture 100 to direct light therefrom to a desired location.

Although fixture 100 will accept a variety of incandescent lamps which include a standard screw-in base, the use of fluorescent flood or spot lights in such installations requires complete replacement of the PAR lamp fixture with an energy light fixture. An illustrative example of a hard wired, energy efficient fluorescent lamp fixture is a model 10301 NITE BLASTER FLOODLIGHT" which is manufactured by Electrodex, Inc. of Bradenton, Fla. The "NITE BLASTER FLOODLIGHT", like the PAR lamp fixture of FIG. 1, includes a threaded mounting tube and a swivel assembly.

As can be seen from the illustrative examples of my adapter in the remaining sheets of the drawing, the advantages of energy efficient lamps are achieved with a PAR lamp fixture without disturbing the hard wired installation.

Figure 2A:
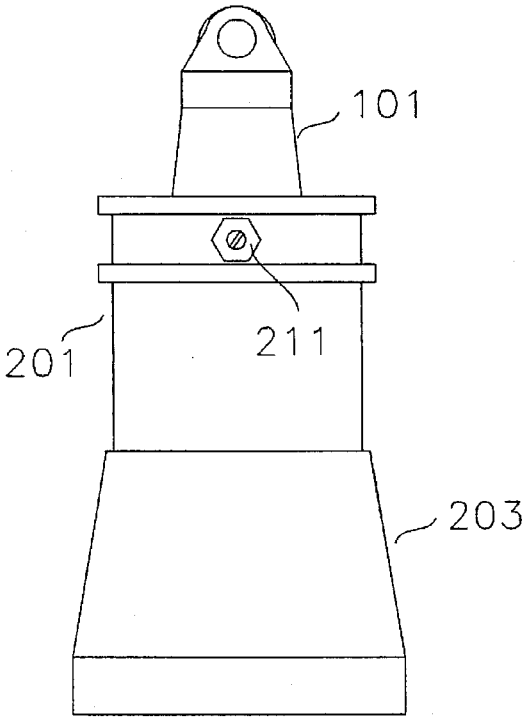
FIGS. 2A and 2B illustrate one form of a PAR lamp adapter in accordance with my invention.
Figure 2B:
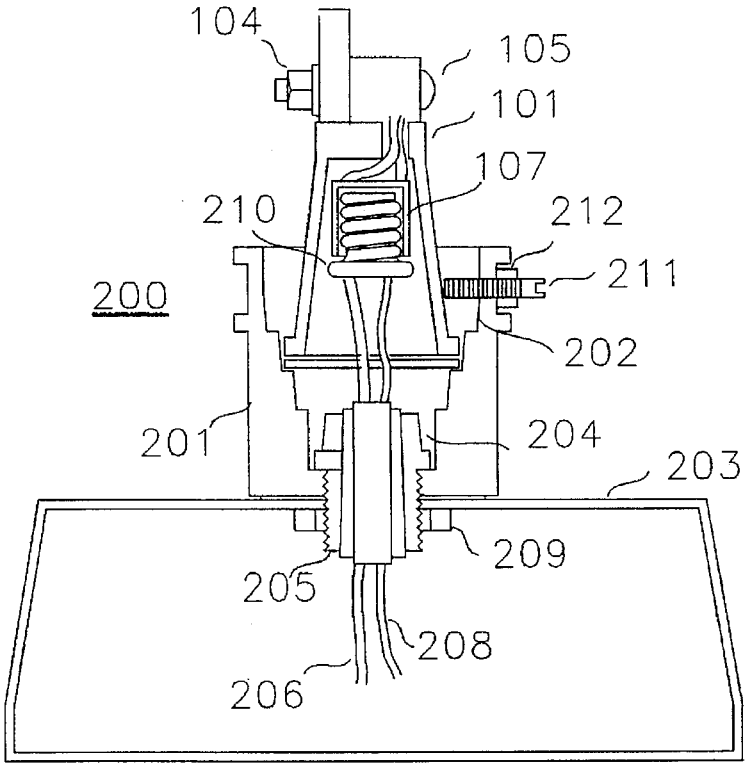

FIGS. 2A and 2B illustrate one form of a PAR lamp adapter in accordance with my present invention. FIG. 2A is a side view of my adapter assembly attached to the body 101 of a PAR lamp fixture; and FIG. 2B is a cross section of the side view of FIG. 2A rotated 90 degrees. My adapter assembly of FIGS. 2A and 2B comprises an energy efficient lamp fixture 203; a tubular mounting 201; a bushing assembly 204, 205, 209; a hard wired plug 210 with a standard base lamp shell; and conductors 206, 208 which connect plug 210 the internal wiring of fixture 203. By way of example, fixture 203 may be a model 10301 "NITE BLASTER FLOODLIGHT" minus its threaded mounting tube and swivel assembly.

As seen in FIG. 2B, the internal diameter of tube 201 is stepped to accommodate a number of standard sizes of PAR lamp fixtures and to receive the threaded portion 205 of the bushing assembly 204. The bushing assembly firmly attaches body 201 to fixture 203; and provides protection and strain relief for conductors 206, 208. An optional unnumbered ring gasket seated between the body 101 of the PAR fixture and the corresponding step in tube 201 provides a seal against the elements of nature. Set screw 211 secures the position of body adapter 201 relative to PAR lamp body 101; and lock nut 212 maintains the setting of screw 211. Although only one set screw is shown in the illustrative embodiment, the use of two or more similarly placed screws is a design option.

Figure 3D:
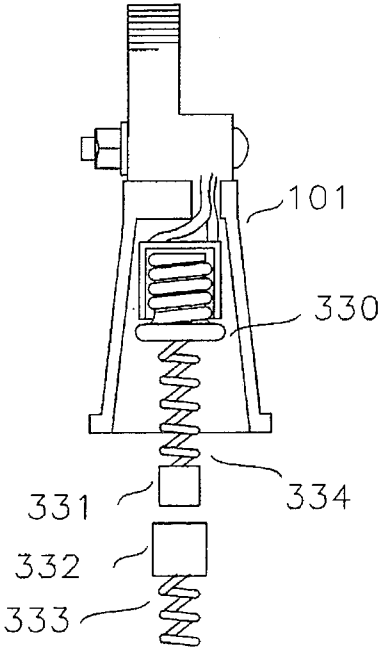
FIGS. 3A, 3B, 3C, and 3D illustrate optional arrangements for electrically connecting an energy efficient fixture to the socket of a PAR lamp fixture in accordance with my invention.
Figure 3C:
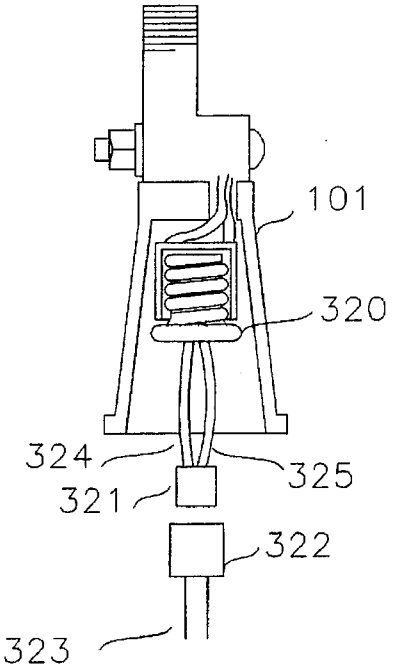
Figure 3B:
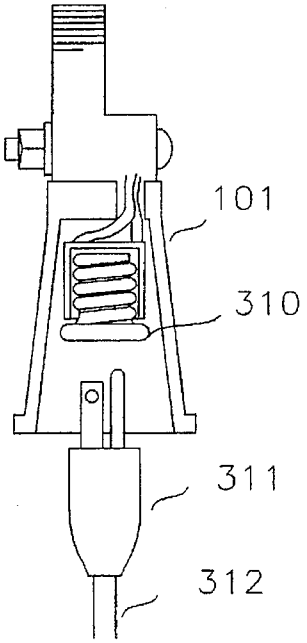
Figure 3A:
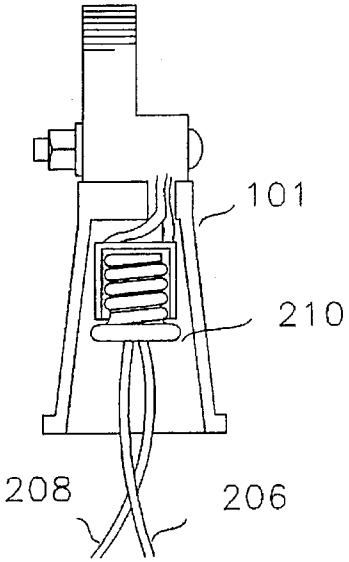

FIGS. 3*a* through 3D illustrate a variety of optional arrangements for electrically coupling fixture 203 to socket 107. FIG. 3A illustrates the hard wired plug arrangement utilized in FIG. 2B. FIG. 3B utilizes a screw in female plug adapter 310 and a two or three conductor electrical cord 312 equipped with a corresponding plug 311. FIGS. 3C and 3D respectively include a hard wired plug 320, 330 and in line connectors 321, 322; 331, 332. FIG. 3C utilizes individual pairs of conductors 324, 325, 323 and FIG. 3D utilizes retractile cords 333, 334.

Figure 4A:
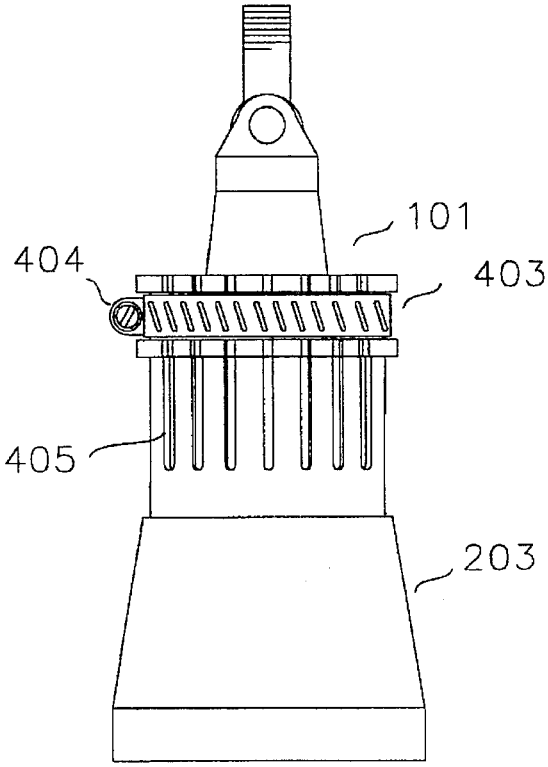
FIGS. 4A and 4B illustrate a second form of PAR lamp adapter in accordance with my invention.
Figure 4B:
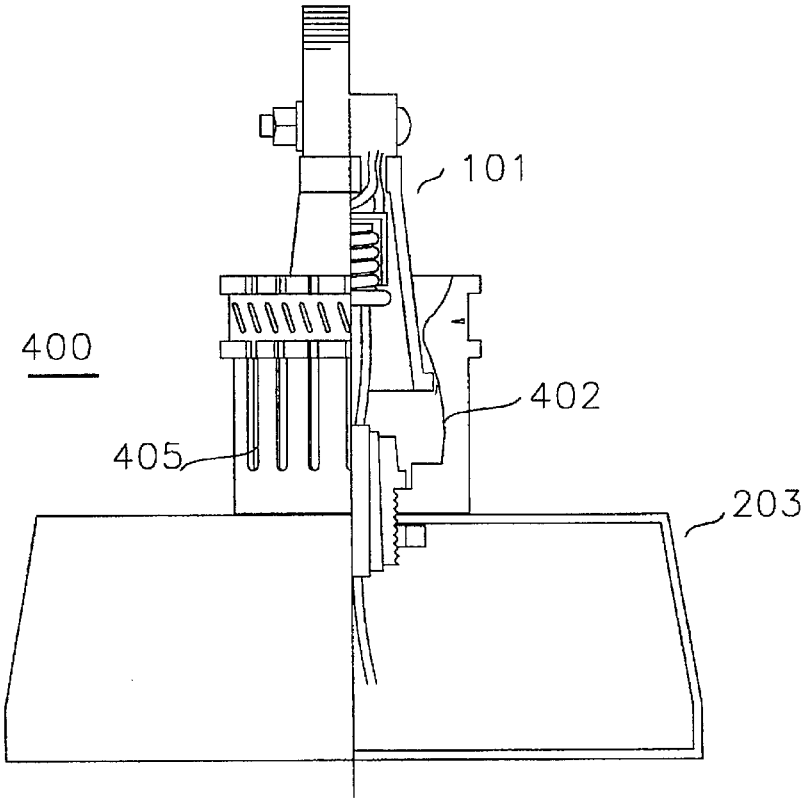

A second form of PAR fixture adapter in accordance with my present invention is illustrated in FIGS. 4A and 4B. FIG. 4A is a side view of the adapter and FIG. 4B is a partial cross section FIG. 4A rotated 90 degrees. My adapter of FIGS. 4A and 4B differs from the adapter of FIGS. 2A and 2B in the manner of physical attachment of the adapter to an existing PAR fixture. The fixture 203 of FIGS. 4A and 4B corresponds to the fixture 203 in FIGS. 2A and 2B; and the bushing assembly 204, 205, 209 of FIG. 2A is used in the adapter of FIGS. 4A and 4B.

The inner diameter of body 405 includes a double tapered ring which is sized to form an interference fit with the large end of the body 101 of a PAR fixture. In order to accommodate insertion of the body 101 of a PAR fixture into the adapter, body 405 has a plurality of spaced apart slots which extend to the large open end of the body to form a plurality of flexible vanes. Accordingly, the large opening in body 405 can be expanded to permit the PAR fixture to pass beyond the normally interfering ring. Screw clamp 403, 404 collapses the adapter against the body 101 of the PAR fixture.

The invention has been described with particular attention to its preferred embodiment; however, it should be understood that variations and modifications within the spirit and scope of the invention may occur to those skilled in the art to which the invention pertains.

What is claimed is:

1. A lamp fixture adapter for PAR lamp fixtures (having) comprising a tapered elongated circular shell body and (a) an electrical socket recessed therein for receiving a PAR lamp, said adapter comprising:

means for electrically coupling an energy efficient light fixture to said socket; and means for physically attaching said energy efficient fixture to said PAR lamp fixture comprising:

a tube (201) open on both ends, a circular opening on one end proportioned to accept the shell of a PAR lamp fixture and a smaller opening on the other end; the inside of the tube comprises stepped inside diameters corresponding to the diameters of standard PAR lamp fixtures, and means (211, 212) for locking said adapter to a PAR lamp fixture.

2. A PAR lamp fixture adapter in accordance with claim 1, wherein:

said means for electrically coupling comprises: a screw plug (210) electrically connected to wires (206, 208) for connection to said energy efficient fixture.

3. A PAR lamp fixture adapter in accordance with claim 1, wherein:

said means for electrically coupling comprises: a screw plug receptacle (310) for receiving a male plug comprising at least two prongs; and an electrical cord (312) comprising a male plug (311) on one end thereof and conductors for electrical connection to said energy efficient fixture.

4. A PAR lamp fixture adapter in accordance with claim 1, wherein:

said means for electrically coupling comprises: a screw plug (320), an in-line female electrical connector (321); conductors (324,325) electrically coupling said screw plug (320) to said in-line female connector (321); a mating in-line male connector (322); and conductors (323) for electrical connection of said male connector to said energy efficient fixture.

5. A PAR lamp fixture adapter in accordance with claim 1, further comprising:

An energy efficient lamp fixture (203); and a through bushing assembly (204, 205, 209) for attaching said adapter to said energy efficient fixture.

6. A lamp fixture adapter for PAR lamp fixtures comprising a tapered elongated circular shell body and an electrical socket recessed therein for receiving a PAR lamp, said adapter comprising:

means for electrically coupling an energy efficient light fixture to said socket; and means for physically attaching said energy efficient fixture to said PAR lamp fixture comprising:

an expandable slotted tube (405) (expandable from a relaxed state to an expanded) (having) comprising: an essentially uniform outside diameter, a circular opening on one end proportioned to accept the shell of a PAR lamp fixture; a smaller opening on the other end; and (the inside of the tube comprises) a double tapered ring formed on the inside of said tube to provide a diameter which is an interference fit with the maximum diameter portion of a standard PAR lamp fixture body; said slotted tube comprising a plurality of vanes and being expandable from a relaxed state to an expanded state to permit said maximum diameter portion of a standard PAR lamp fixture body to pass through said tube beyond said tapered ring; and clamping means (403, 404) securing said tube tightly about said PAR lamp fixture.

7. A PAR lamp fixture adapter in accordance with claim 6, wherein:

said means for electrically coupling comprises: a screw plug (210) electrically connected to wires (206, 208) for connection to said energy efficient fixture.

8. A PAR lamp fixture adapter in accordance with claim 6, wherein:

said means for electrically coupling comprises: a screw plug receptacle (310) for receiving a male plug comprising at least two prongs; and an electrical cord (312) comprising a male plug (311) on one end thereof and conductors for electrical connection to said energy efficient fixture.

9. A PAR lamp fixture adapter in accordance with claim 6, wherein:

said means for electrically coupling comprises: a screw plug (320), an in-line female electrical connector (321); conductors (324,325) electrically coupling said screw plug (320) to said in-line female connector (321); a mating in-line male connector (322); and conductors (323) for electrical connection of said male connector to said energy efficient fixture.

10. A PAR lamp fixture adapter in accordance with claim 6, further comprising:

An energy efficient lamp fixture (203); and a through bushing assembly (204, 205, 209) for attaching said adapter to said energy efficient fixture.

* * * * *